US006046758A

United States Patent [19]

Brown et al.

[11] Patent Number: 6,046,758

[45] Date of Patent: Apr. 4, 2000

[54] HIGHLY WEAR-RESISTANT THERMAL PRINT HEADS WITH SILICON-DOPED DIAMOND-LIKE CARBON PROTECTIVE COATINGS

[75] Inventors: David Ward Brown, Lansdale; Melissa Baylog, Easton; Fred M. Kimock, Macungie; Bradley J. Knapp, Kutztown; Rudolph Hugo Petrmichl, Center Valley; Edward George Thear, Macungie, all of Pa.

[73] Assignee: Diamonex, Incorporated, Allentown, Pa.

[21] Appl. No.: 09/264,753

[22] Filed: Mar. 9, 1999

Related U.S. Application Data

[60] Provisional application No. 60/077,464, Mar. 10, 1998.

[51] Int. Cl.[7] ..... B41J 2/335

[52] U.S. Cl. ..... 347/203

[58] Field of Search ..... 347/203; 427/122, 427/249, 534, 563, 562, 577, 579, 527, 255.1

[56] References Cited

U.S. PATENT DOCUMENTS 5,238,705 8/1993 Hayashi et al. ..... 427/122
5,508,368 4/1996 Knapp et al. ..... 427/354

FOREIGN PATENT DOCUMENTS 58-042473 3/1983 Japan ..... 347/203
62-227763 10/1987 Japan ..... 347/203

*Primary Examiner*—Huan Tran
*Attorney, Agent, or Firm*—Coudert Brothers

[57] ABSTRACT

The invention provides a thermal print head with a protective coating of silicon-doped diamond-like carbon (Si-DLC) which imparts superior wear resistance, and improved lifetime. The Si-DLC is comprised of the elements C, H, Si and possibly O, N and Ar. The highly wear and abrasion-resistant Si-DLC diamond-like carbon coating is deposited by ion-assisted plasma deposition including direct ion beam deposition and capacitive radio frequency plasma deposition, from carbon-containing and silicon-containing precursor gases consisting of hydrocarbon, silane, organosilane, organosilazane and organo-oxysilicon compounds, or mixtures thereof. The resulting Si-DLC coating has the properties of Nanoindentation hardness in the range of approximately 10 to 35 GPa, thickness in the range of approximately 0.5 to 20 micrometers, dynamic friction coefficient of less than approximately 0.2, and a silicon concentration in the range of approximately 5 atomic % to approximately 40 atomic %. Optimum performance is obtained when the Si-DLC coating hardness is in the range of approximately 15 to 35 GPa, preferably in the range of about 15 GPa to about 19 GPa, and the Si-DLC layer thickness is in the range of approximately 2 micrometers to approximately 10 micrometers, dynamic friction coefficient of less than approximately 0.15, and a silicon concentration in the range of approximately 10 atomic % to 30 atomic %, preferably in the range of about 15 atomic percent to about 24 atomic percent.

31 Claims, 2 Drawing Sheets

HIGHLY WEAR-RESISTANT THERMAL PRINT HEADS WITH SILICON-DOPED DIAMOND-LIKE CARBON PROTECTIVE COATINGS

This application is based on provisional application Ser. Number 60/077,464, filed Mar. 10, 1998.

FIELD OF THE INVENTION

This invention relates to thermal print heads used in printing images on paper and related media. More particularly, the invention relates to thermal print heads which are coated with a thin, protective layer of silicon-doped diamond-like carbon (Si-DLC), and a process for deposition of the Si-DLC layer.

BACKGROUND OF THE INVENTION

Many methods are currently known for transferring print onto paper, including xerography and thermal printing. In thermal printing, a heat-sensitive paper is moved across a thermal head which transfers the image to the paper by applying localized pulses of heat, at up to 400° C., in small spots to the surface of the paper. The localized hot spots activate a heat-sensitive chemical on the paper, which turns dark thus producing an image, as the paper moves across the thermal head.

Both thick film thermal heads and thin film thermal heads (thermal print heads) are known in the art, and are used for different applications.

Thick film thermal print heads provide high speed printing on thermally-sensitive paper for high speed graphics and bar code printing applications such as lottery and race track ticket printers, airline ticket printers and bar code label printers for many applications. In most of these applications, the paper to be printed is coarse and abrasive. In addition, these thermal printers are often used in situations where the environment is not well-controlled, e.g. in warehouses at race tracks, etc. In these situations, the thermal print head becomes exposed to degrading environmental conditions such as dust, high humidity and acidic vapors (from acid rain) and chemical vapors.

A typical thermal print head for these applications has a size of approximately 1 inch wide×4 inches long×⅛ inch thick, made of a ceramic substrate, such as aluminum oxide. Prior to deposition of the resistor strip, a projected glaze strip, made of glass or a glass-ceramic material may be applied to the substrate. A resistor strip comprised of a plurality of closely spaced heating elements ("dots") of resistor material (made of ruthenium oxide, tantalum oxide, titanium oxide, titanium silicide, nichrome, or other resistive material) is deposited over the substrate, and on top of the projected glaze strip, if present. The individual heating elements of the resistor strip are connected on two sides to conductor lines, which are typically made of metals such as gold or silver. For protection, the resistor strip may be encapsulated by a layer of glass or glass-ceramic glaze, having a thickness up to about 25 micrometers. Alternatively, the resistor strip may be protected by a hard coating layer of vacuum deposited ceramic material. An electric current (typically pulsed) applied via the conductor lines to the resistor dots produces resistive heating of the resistive element to a temperature in the typical range of approximately 350° C. to 400° C. or greater. When a heat pulse from the resistor dot comes in contact with thermally sensitive paper, the dot image is transferred onto the paper. By appropriate application of electrical pulses to the heating elements, and moving the paper across the print head, the bar code label or ticket information is printed onto the paper.

Thin film thermal print heads all have similar construction to thick film thermal print heads, except that the layers of materials used to build up the thermal print head are thinner, and normally deposited by thin film vacuum deposition technology. Thin film thermal print heads are most often used in applications where the environmental conditions are less severe, and the paper to be printed is less abrasive, e.g. in facsimile machines. A common, simple thin film thermal print head construction might entail an aluminum oxide ceramic substrate, a resistor material of nichrome which is less than 1 micrometer thick, and a protective layer of silicon nitride, which is less than 2 micrometers thick.

The susceptibility of each of the prior art thermal heads to failure after extended operation is well known. Several mechanisms contribute to premature failure of the thermal head, including removal of, or damage to the protective coating by abrasive wear, corrosion, and thermal degradation. Abrasive wear is believed to occur due to rubbing of the print head surface by hard particles such as titanium oxide particles in the paper, or unwanted debris such as sand, or other silicate or oxide materials which are present in the environment. The low hardness and high friction surfaces of prior art print heads, which are coated with protective layers such as glass, silicon oxynitride and silicon nitride, make them susceptible to abrasive damage by these particles. In addition, the thermal head may be damaged by corrosion by chemicals such as water, salts, acids and other chemicals in the paper and the environment, if the protective coating is not resistant to these materials. Finally, the thermal cycling to which the resistor material is subjected can lead to thermal degradation over time. This situation is made worse by the use of protective coatings which have poor thermal conductivity, such as glass or amorphous silicon nitride. In the search for improved wear resistance, manufacturers have attempted to increase the thickness of protective coatings such as glass or silicon nitride. Because of the poor thermal conductivity of these layers, increased electrical power must be applied to the resistor elements to make them hotter, in order achieve the same temperature at the surface of the print head to cause the color change in the thermally-sensitive paper. This increased temperature of the resistor element shortens its lifetime.

There are many configurations of thermal heads known in the prior art, all of which exhibit the aforementioned limitations.

For example, Ogawa et al., U.S. Pat. No. 4,708,915, describe a thermal head for thermal recording having a protective coating composed of tantalum silicon oxynitride. An undercoat may be formed between this protective coating and the heat-generating resistors and electrodes.

Shibata, U.S. Pat. No. 4,768,038, discloses a thermal printing head having a plurality of electrodes disposed on an insulating substrate, in an upper layer and a lower layer. The electrodes are connected to a heat generating layer between the electrodes, and are isolated by a layer of plasma-deposited silicon nitride or silicon oxide.

Sugiyama, U.S. Pat. Nos. 5,021,806 and 5,095,318, describes a thermal print head comprising a substrate; an electrically insulating layer coated over the substrate; a heating means coated over the insulating layer, for providing heat for printing a dot of a picture; a protective coating layer applied over the heating means; and a dot area control means. The protective coating layer may be an oxidation resistant material.

Nakayama, et al., U.S. Pat. No. 5,557,313, disclose a sputter-deposited wear-resistant protective film for a thermal head consisting of a metal oxide, metal nitride, and mixtures thereof, such as silicon oxynitride, wherein the coating has an inert gas concentration of 2 to 10 atomic percent.

Diamond-like carbon (DLC) coatings, which can be composed of pure carbon, or carbon and hydrogen, are well known in the prior art. These DLC materials are known to exhibit excellent mechanical properties such as high hardness of about 10 to about 80 GPa, low coefficient of friction of approximately 0.2 or less, excellent resistance to abrasion, and resistance to corrosion by water, acids, bases, and solvents. Therefore, it would be expected that DLC coatings would perform well as protective coatings on thermal print heads. However, it was found that standard DLC coatings deposited by direct ion beam deposition from methane gas were rapidly degraded and worn away during thermal printing because of the high temperatures, i.e. approximately 400° C. or greater, to which the coatings were exposed during the thermal printing process.

From the above discussion it is clear that an improved protective coating for thermal print heads is needed that exhibits improved wear resistance and excellent thermal stability without sacrificing printing performance and resolution of the thermal head.

SUMMARY OF THE INVENTION

The invention provides a thermal print head with a protective coating which imparts superior wear resistance, and improved lifetime. More particularly, this invention provides a Si-doped DLC (Si-DLC) coating to the surface of a thermal print head which is highly adherent and exhibits greatly improved wear resistance and environmental durability. This invention also provides a low cost and efficient process for mass-producing the coated thermal print heads with improved wear resistance and superior lifetime.

The protective coating of the present invention consists of at least a layer of Si-DLC which is comprised of the elements C, H, Si and possibly O, N and Ar.

The highly wear and abrasion-resistant Si-DLC diamond-like carbon coating is deposited by ion-assisted plasma deposition including direct ion beam deposition and capacitive radio frequency plasma deposition, from carbon-containing and silicon-containing precursor gases consisting of hydrocarbon, silane, organosilane, organosilazane and organo-oxysilicon compounds, or mixtures thereof. The resulting Si-DLC coatings of the present invention are characterized by the following properties: Nanoindentation hardness in the range of approximately 10 to 35 GPa, a thickness in the range of approximately 0.5 to 20 micrometers, dynamic friction coefficient, measured against a sapphire ball, of less than approximately 0.2, and a silicon concentration in the range of approximately 5 atomic % to approximately 40 atomic %. Optimum performance for thermal print heads subjected to severe wear environments is obtained when the Si-DLC coating hardness is in the range of approximately 15 to 35 GPa, preferably in the range of about 15 GPa to about 19 GPa, and the Si-DLC layer thickness is in the range of approximately 2 micrometers to approximately 10 micrometers, dynamic friction coefficient of less than approximately 0.15, and a silicon concentration in the range of approximately 10 atomic % to 30 atomic %, preferably in the range of about 15 atomic percent to about 24 atomic percent.

BRIEF DESCRIPTION OF THE DRAWINGS

Further features and advantages will become apparent from the following and more particular description of the preferred embodiment of the invention, as illustrated in the accompanying drawings in which.

DETAILED DESCRIPTION OF THE INVENTION

The present invention substantially reduces or eliminates the disadvantages and shortcomings associated with the prior art techniques by providing for the deposition of a highly durable and abrasion-resistant Si-DLC coating onto the wear surface of a thermal print head.

Figure 1:
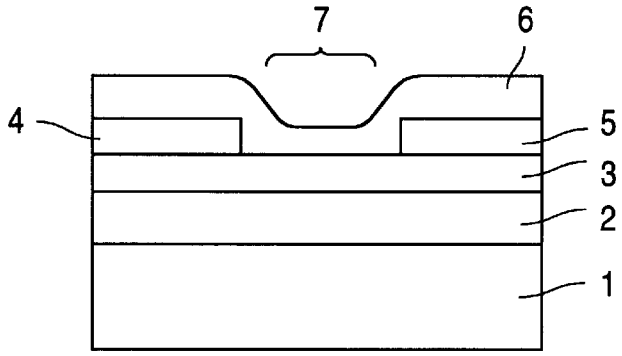
FIG. 1 (PRIOR ART)
FIG. 1 is a diagrammatic view, partially in cross-section, of an illustrative structure of a thermal print head of the prior art.

The thermal print head of the present invention is an improvement over prior art thermal print heads, such as those described in FIG. 1, which is substantially the same as FIG. 1 of Nakayama et al, U.S. Pat. No. 5, 557,313, the relevant portions of which are incorporated herein by reference. FIG. 1 shows a prior art structure containing a substrate 1 composed of an electrically insulating material such as alumina, a layer of glass glaze 2, a heating element layer 3 made of polysilicon or the like, electrical connectors or electrodes 4 and 5 connected to heating element 3, and a wear-resistant protective film 6. The space between the electrodes which defines the printing dot is indicated as the heat-developing zone 7. The resistive layer is actually composed of a plurality of electrically resistive heating elements arranged in a row.

Figure 2:
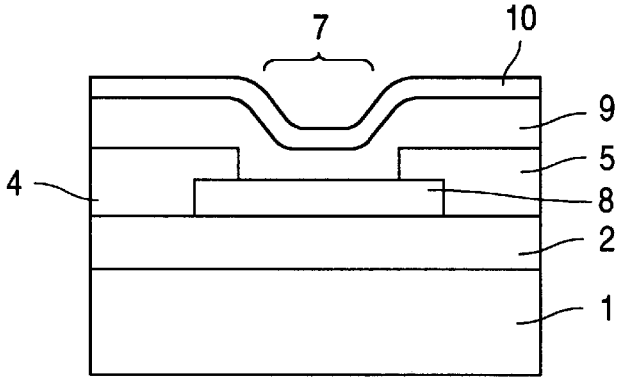
FIG. 2 is a diagrammatic view, partially in cross-section, of an illustrative structure of a preferred embodiment of the thermal print heads of the present invention for use in severe wear environments.

FIG. 2 presents a preferred embodiment of the highly wear resistant thermal print heads of the present invention for use in severe wear environments. Referring to FIG. 2, the thermal print heads of the present invention consists of an electrically insulating substrate 1, upon which is applied a projected glaze strip 2, made of glass or a glass-ceramic material. A resistive layer composed of a plurality electrically resistive heating elements 8 is applied over the top of the glaze strip 2. The resistive elements 8 are heated by passage of a heating current via electrical connectors 4 and 5. The space between the electrodes defines the minimum size of the printing dot and the heat-developing zone 7. A layer of encapsulating glass or glass-ceramic 9 is applied over top of the resistive heating elements 8 and at least part of the conductors 4 and 5. Finally, a highly wear resistant layer of Si-DLC 10 is applied on top of glass layer.

Figure 3:
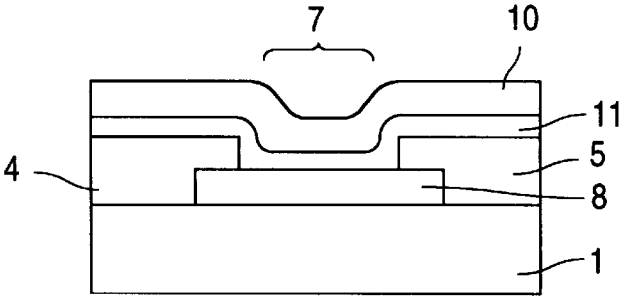
FIG. 3 is a diagrammatic view, partially in cross-section, of an illustrative structure of another preferred embodiment of the thermal print heads of the present invention.

FIG. 3 presents another preferred embodiment of the highly wear-resistant thermal print head products of the present invention, which is appropriate for applications which require high wear resistance, but cannot tolerate the thermal resistance of the aforementioned glass or glass-ceramic layer 9. This embodiment consists of an electrically insulating substrate 1, upon which is applied a resistive layer composed of a plurality electrically resistive heating elements 8. Optionally, a glaze strip (not shown) made of glass or glass-ceramic material may be applied onto the substrate surface prior to application of the resistor strip comprised of electrically resistive heating elements 8. The resistive elements 8 are heated by passage of a heating current via electrical connectors 4 and 5. The space between the electrodes defines the minimum size of the printing dot and the heat-developing zone 7. An insulating layer 11 of a ceramic material such as a metal carbide, metal oxide, metal nitride, or metal oxynitride is applied over the resistive heating elements 8. Materials such as silicon nitride, silicon oxide, silicon oxynitride, silicon carbide, silicon oxy-carbide, aluminum oxide, titanium oxide, tantalum oxide and mixtures thereof are preferred materials for this layer. The insulating layer has a thickness in the range of approximately 0.5 to 10 micrometers. Finally, a highly wear resistant layer of Si-DLC 10 is applied on top of the thin ceramic layer 11.

The top layer 10 of the structures in FIG. 2 and FIG. 3 is a protective layer of Si-DLC which is deposited by ion-assisted plasma deposition from carbon-containing and silicon-containing precursor gases.

There are two preferred methods of ion-assisted plasma deposition of the Si-DLC coatings of the present invention. In the first method, the Si-DLC coatings are deposited by direct ion beam deposition from an ion beam generated from carbon-containing and silicon-containing precursor gases, which may be carried out using a gridded or gridless ion source. Gridded ion beam sources may include Kaufmann-type ion beam sources, or gridded RF plasma ion beam sources. Gridless ion sources include End Hall ion sources and Hall-current ion sources such a Closed-Drift ion sources. In the second method, the Si-DLC coatings are deposited by capacitively-coupled radio frequency plasma deposition from carbon-containing and silicon-containing precursor gases. In both preferred methods, the ions for the deposition process are generated in a plasma of carbon-containing and silicon-containing precursor gases selected from the group consisting of hydrocarbon, silane, organosilane, organosilazane and organo-oxysilicon compounds, or mixtures thereof.

The resulting Si-DLC coatings of the present invention are characterized by the following properties: a Nanoindentation hardness in the range of approximately 10 to 35 GPa, a thickness in the range of approximately 0.5 to 20 micrometers, a dynamic friction coefficient, measured against a sapphire ball, of less than approximately 0.2, and a silicon concentration in the range of approximately 5 atomic % to approximately 40 atomic %. In addition to being composed of the elements C, H and Si, the Si-DLC coatings of the present invention may also contain the elements O, N and Ar.

In the method of present invention, a thermal print head is first formed by depositing onto an electrically insulating substrate at least a pattern of a plurality of electrically resistive heating elements in contact with a pattern of electrically conducting elements which are capable of passing electrical current through the heating elements. Then, a layer of electrically insulating material is deposited over the heating elements. Finally, a protective layer of Si-DLC is deposited over the electrically insulating layer by ion-assisted plasma deposition.

If the Si-DLC layer is to be deposited onto materials of the thermal print head structure which have been exposed to air or other environmental contaminants, the surface of the thermal print head substrate is first cleaned to remove unwanted materials and other contaminants. In the second step, the thermal print head substrate is inserted into a vacuum chamber, and the air in said chamber is evacuated. In the third step, the substrate surface is sputter-etched with energetic ions to assist in the removal of residual contaminants, i.e. hydrocarbons and surface oxides, and to activate the surface. Following completion of the sputter-etch, a Si-DLC layer is deposited by ion-assisted plasma deposition. Once the chosen thickness of the Si-DLC layer has been achieved, the deposition process on the substrates is terminated, the vacuum chamber pressure is increased to atmospheric pressure, and the Si-DLC-coated substrates are removed from the vacuum chamber.

Alternatively, the Si-DLC layer may be ion beam deposited onto the thermal print head wear surface immediately upon completion of deposition of the resistive heating material, or electrically insulating material, without removing the substrate from the vacuum chamber.

The method of the present invention substantially reduces or eliminates the disadvantages and shortcomings associated with the prior art thermal print heads by providing for the deposition of a highly wear-resistant, corrosion-resistant and protective, amorphous Si-DLC coating onto the surface of a thermal print head, which surface comes in contact with the paper or media to be printed. Using the ion-assisted plasma deposition method of the present invention, the protective Si-DLC coatings can be deposited over large areas with high throughput, resulting in an economically viable process.

The Si-DLC coated thermal print head products of the present invention substantially reduce or eliminate the disadvantages and shortcomings associated with the prior art thermal print heads by providing remarkably improved abrasion and wear resistance due to the high hardness and low friction coefficient of the Si-DLC coating.

It has been surprisingly found that the wear resistance of the Si-DLC coated products of the present invention remarkably exceeds the wear resistance of silicon nitride coated thermal print head products, even though the thickness of the Si-DLC coating may be less than the thickness of the silicon nitride coating, and the Si-DLC coating may be less hard than the silicon nitride coating. This remarkable performance improvement is not completely understood at the present time, but is thought to be due to the very low dynamic friction and high elasticity of the Si-DLC coatings of the present invention.

The Si-DLC coatings of the present invention have tribological and mechanical properties of hardness, friction coefficient and elastic modulus which are comparable to, or superior to standard DLC coatings, but the thermal stability of the Si-DLC coatings at temperatures in the range of 400° C. or higher is greatly improved over standard DLC materials. The combination of excellent tribological properties with thermal stability in air at temperatures in the range of approximately 400° C. to 500° C. makes the Si-DLC coatings of the present invention ideal as a protective coating for thermal print heads which are subject to abrasive conditions.

Figure 4:
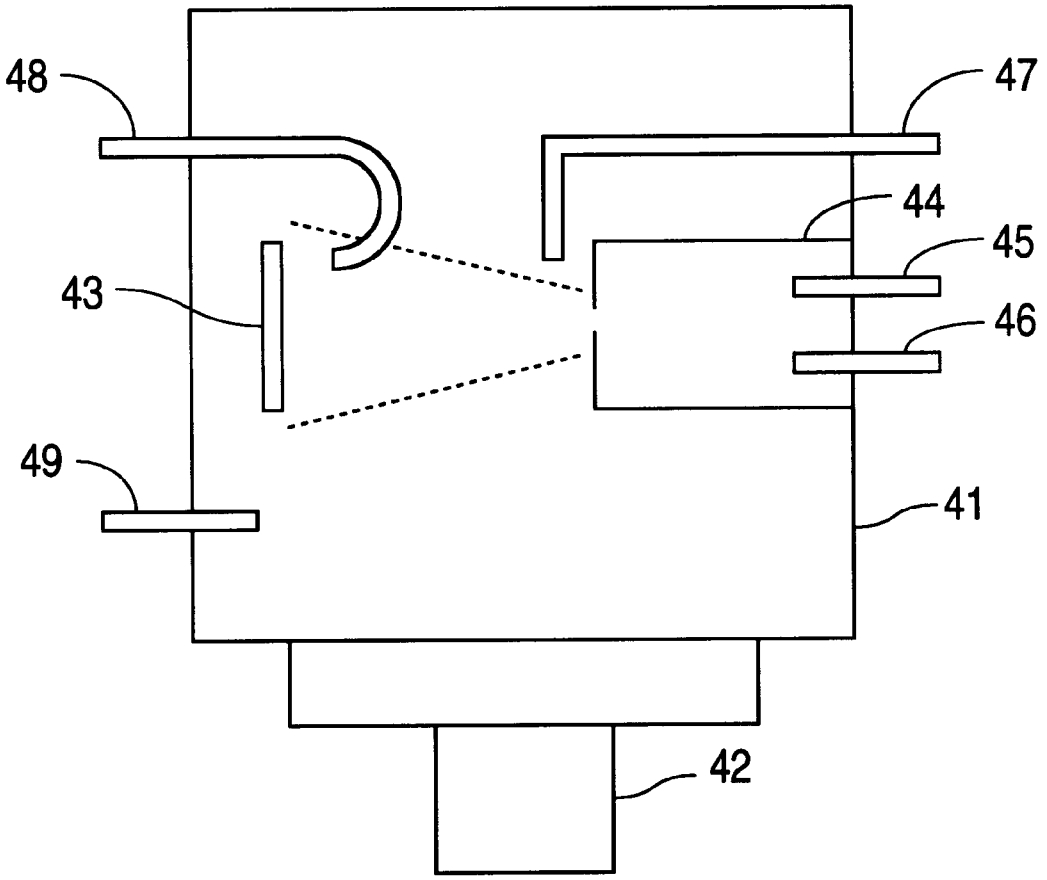
FIG. 4 is a schematic view of an ion beam deposition apparatus used to manufacture the Si-DLC coatings in accordance with the present invention.

The preferred ion beam deposition apparatus for carrying out the ion-assisted plasma deposition process of the present invention is illustrated schematically in FIG. 4. The coating process is carried out inside a high vacuum chamber 41 which is fabricated according to techniques known in the art. Vacuum chamber 41 is evacuated into the high vacuum region by first pumping with a rough vacuum pump (not shown) and then by a high vacuum pump 42. Pump 42 is preferably a diffusion pump, turbomolecular pump, or other high vacuum pump known in the art. A cryogenically cooled coil, (not shown) is typically also installed inside chamber 41 to assist with pumping water vapor, as well as condensible precursor gases used with the process of the present invention.

It is understood that the process of the present invention can be carried out in a batch-type vacuum deposition system, in which the main vacuum chamber is evacuated and vented to the atmosphere after processing each batch of parts; a load-locked deposition system, in which the main vacuum deposition chamber is maintained under vacuum at all times, but batches of parts to be coated are shuttled in and out of the deposition zone through vacuum-to-air load locks; or in-line processing vacuum deposition chambers in which parts are flowed constantly from atmosphere, through differential pumping zones, into the deposition chamber, back through differential pumping zones, and returned to atmospheric pressure.

Thermal print head substrates to be coated are mounted on substrate holder 43, which may incorporate tilt, simple rotation, planetary motion, or combinations thereof. A heater (not shown) may be located behind or within the substrate holder for the purposes of heating the substrates to the temperature range of about 100° C. to about 500° C., if required for the deposition of Si-DLC. The substrate holder can be in the vertical or horizontal orientation, or at any angle in between. Vertical orientation is preferred to minimize particulate contamination of the substrates, but if special precautions such as low turbulence vacuum pumping and careful chamber maintenance are practiced, the substrates can be mounted in the horizontal position and held in place by gravity. This horizontal mounting is advantageous from the point of view of easy fixturing of small substrates such as individual sliders. This horizontal geometry can be most easily visualized by rotating FIG. 4 by 90 degrees.

Prior to deposition, the thermal print head substrates are ion beam sputter-etched with an energetic ion beam generated in ion beam source 44. Ion beam source 44 can be any ion source known in the prior art, including Kaufmann-type direct current discharge ion sources, radio frequency or microwave frequency plasma discharge ion sources, each having one, two, or three grids, or gridless ion sources such as the End Hall ion source of U.S. Pat. No. 4,862,032, or a Hall Current ion source such as a Closed Drift ion source. The ion beam produced by the ion source is charge neutralized by introduction of electrons into the beam using a neutralizer (not shown), which may be a thermionic filament, plasma bridge, hollow cathode, or other types known in the prior art.

Ion source 44 is provided with inlets for introduction of inert gases 45, such as argon, krypton, and xenon, for the sputter-etching, and for introduction of precursor gas mixtures 46, for deposition of Si-DLC layers. The precursor gas mixture is made up of carbon-containing and silicon-containing gases including, but not limited to hydrocarbon compounds, silane compounds, organosilane compounds, organosilazane compounds and organo-oxysilicon compounds which may be mixed with hydrocarbon compounds and mixtures thereof. Suitable hydrocarbon gases include but are not limited to methane, ethane, acetylene, butane, cyclohexane and mixtures thereof. Suitable silane compounds include silane, disilane and mixtures thereof. Suitable organosilane compounds include, but are not limited to diethylsilane, tetramethylsilane and mixtures thereof. Suitable organosilazane compounds include but are not limited to hexamethyldisilazane, tetramethyldisilazane and mixtures thereof. Suitable organo-oxysilicon compounds include but are not limited to hexamethyldisiloxane, tetramethyldisiloxane, ethoxytrimethylsilane, octamethycyclotetrasiloxane, and mixtures thereof. Inert gases such as argon, krypton, xenon and neon may be added to the precursor gas to stabilize the plasma and modify the properties of the deposited Si-DLC material. The precursor gas mixture may further contain nitrogen or oxygen.

A critical feature is that a silicon-containing precursor gas is introduced into the ion beam source to provide the silicon doping level in the Si-DLC coatings which is required to obtain excellent adhesion, wear resistance and thermal stability of the Si-DLC coatings of the present invention. An additional ion source (not shown) can be used to co-bombard the substrates during Si-doped DLC deposition to alter the film properties.

If ion source 44 is a gridless type such as an End Hall source or a Hall Current ion source such as a Closed Drift source, at least a portion of the reactive organosilane, organosiloxane, organosilazane, or other precursor gases is introduced downstream of the ion source and into the ion beam by inlet 47. Inlet 47 may contain multiple holes for the introduction of reactive gases, or may be a "gas distribution ring". Volatile precursors can be contained in some type of vessel (not shown) which may be heated, and introduced directly into the vacuum chamber by inlet 47 via a metering valve (not shown) or mass flow controller (not shown) located between the containment vessel and inlet 47. The precursor materials can also be introduced using a liquid delivery mass flow controller (not shown) followed by an evaporator (not shown) which feeds inlet 47.

Finally, additional reactive gases for the deposition, e.g. oxygen and ammonia, can be introduced at or near the substrate by inlet 48, or into the chamber background by inlet 49. The reactive gases introduced by inlet 48 modify the properties of the abrasion-resistant Si-DLC material by chemical reaction at the surface of the coating during deposition.

Additionally, to improve the deposition rate and throughput of the coating machine, multiple ion sources 44 can be utilized and operated simultaneously.

It is understood that deposition of other highly abrasion-resistant coating layers such as the silicon oxy-carbide material described in by Knapp et al. in U.S. Pat. No. 5,508,368 can be deposited with the ion beam deposition apparatus shown in FIG. 4. For the case of thin film thermal print heads, this type of coating material containing the elements Si, C, H and O is advantageous as a stress buffer layer between the resistor strip and the Si-DLC top coating.

According to the method of the present invention, after preparation to define the resistive heating elements, electrical contacts and insulating layer, the substrate is first chemically cleaned to remove contaminants. Ultrasonic cleaning in solvents, or other detergents as known in the art is often effective. It has been found that it is critical for this step to be effective in removing surface contaminants and residues, or the resulting adhesion of the Si-DLC coating will be poor.

In the second step, the substrate is inserted into a vacuum chamber, and the air in said chamber is evacuated. Typically, the vacuum chamber is evacuated to a pressure of about $1\times10^{-5}$ Torr or less to ensure removal of water vapor and other contaminants from the vacuum system. However, the required level of vacuum which must be attained prior to initiating the next step must be determined by experimentation. The exact level of vacuum is dependent upon the nature of the substrate material, the sputter-etching rate, and the constituents present in the vacuum chamber residual gas.

In the third step, the substrate surface is bombarded with energetic gas ions to assist in the removal of residual contaminants, e.g. any residual hydrocarbons, and other contaminants, and to activate the surface. This sputter-etching of the substrate surface greatly improves the adhesion of the Si-DLC layer. The sputter-etching is typically carried out with inert gases such as argon, krypton, and xenon, but other gases (e.g. nitrogen) can be used if they do not adversely affect adhesion. Additionally, hydrogen may be added to the ion beam during sputter-etching to assist in activation of the surface. Typically, in order to achieve efficient and rapid ion sputter-etching, the ion beam energy is greater than 20 eV. Ion energies as high as 2000 eV can be used, but ion beam energies in the range of about 20 to about 1000 eV result in the least amount of atomic scale damage to the thermal print head substrate.

Immediately following the sputter etch step, the Si-DLC layer is deposited by ion assisted plasma deposition. It is important to minimize the time between completion of the etch step and the start of the deposition of the Si-DLC layer. Deposition of the Si-DLC layer immediately after completion of the sputter-etching step minimizes the possibility for recontamination of the substrate surface with vacuum chamber residual gases or other contaminants. The thickness of the protective ion assisted plasma deposited Si-DLC coating is constrained to small dimensions since the coating thickness adds directly to the thermal resistance of the thermal print head. Depending on the design of the thermal print head and the wear-resistance requirements, the thickness of the Si-DLC layer is in the range of 0.5 micrometer to 20 micrometers. Thinner Si-DLC layers provide less thermal resistance, but offer less wear resistance. Thicker Si-DLC layer provide much greater wear resistance, but require higher heating element temperatures. The actual Si-DLC thickness is determined based on the requirements of the printing application.

For sake of process simplicity, rapid deposition, and ease of scale-up to mass production, the preferred deposition processes for this invention is direct ion beam deposition from carbon-containing and silicon-containing precursor gas, which may be mixed with an inert gas. The most preferred silicon-containing precursor gas is tetramethylsilane (TMS), but other gases such as silane and diethylsilane may be used as silicon-containing precursors. The inert gas may be chosen from any of the group VIII gases of the periodic table of the elements, but argon is most preferred due to its availability. Hydrogen and hydrocarbon gases, including but not limited to methane, ethane, butane, acetylene and cyclohexane, may be introduced into the ion source plasma along with the silicon-containing precursor gas to modify the properties of the Si-DLC coating. The ion beam energy used in the Si-DLC deposition process may be in the range of approximately 20 eV to approximately 1000 eV. Use of higher ion beam energies in the range of 200 eV to 1000 eV has been found to produce advantageous tribological properties and high hardness. For deposition of the Si-DLC coatings of the present invention, it is typical to utilize substrate temperatures in the range of 100° C. to 500° C. Generally, higher substrate temperatures produce harder coatings. It has been found that if the ion beam energy is in the range of 100 eV to 1000 eV, which is readily achieved with gridded ion beam sources, additional substrate heating is not required to achieve the optimum properties of high hardness, low dynamic friction and high wear resistance of the Si-DLC coatings, and the substrate temperature may be maintained in the range of approximately 100° C. to 250° C. during deposition. For gridless ion beam sources such as End Hall sources and Hall Current sources, it has been found that the ion beam energy is typically in the range of approximately 20 eV to 100 eV. In this case, it is advantageous to apply additional heat to the substrate to increase the substrate temperature to the range of approximately 150° C. to 400° C. during the deposition of Si-DLC to achieve the optimum properties of high hardness, low dynamic friction and high wear resistance of the Si-DLC coatings.

Once the chosen thickness of the Si-DLC layer has been achieved, the deposition process on the thermal print head substrates is terminated, the vacuum chamber pressure is increased to atmospheric pressure, and the coated substrates are removed from the vacuum chamber.

It is understood that if the Si-DLC coating is to be deposited in the same vacuum chamber as the insulating layer without breaking vacuum, it is not necessary to chemically clean or sputter-etch the surface of the insulating layer prior to deposition of the Si-DLC layer. In this situation, the Si-DLC layer may be ion beam deposited immediately upon completion of deposition of the insulating layer over the resistive heating elements.

Alternatively, the ion-assisted plasma deposition process of the present invention may be carried out in a capacitive radio frequency plasma deposition apparatus (not shown) such as that described by Rogers et al., in co-pending provisional patent application Ser. No. 60/074,297, filed Feb. 11, 1998 (Docket No. 6051/53395), and the corresponding co-pending patent application Ser. No. 09/246,976, filed Feb. 9, 1999 (Docket No. 6051/53766) the relevant portions of which are incorporated herein by reference. The advantages of this process for deposition of Si-DLC on thermal print head substrates are in the simplicity of fixturing for coating, and the high deposition rate of Si-DLC of greater than 2 micrometers per hour which can be obtained.

EXAMPLES

Examples 1–13 illustrate representative processes for deposition of the Si-DLC coatings of the present invention, and characteristics of the Si-DLC coatings which were applied to thermal print heads. In Examples 1–8, products illustrated in FIG. 2 were obtained by ion beam deposition of Si-DLC layers onto the surface of commercially available thermal print heads in which the resistor strip was encapsulated with a glass-ceramic protective layer. In Examples 1–3, Si-DLC coatings were ion beam deposited with a gridded Kaufmann-type ion beam source using tetramethylisilane (TMS) as the carbon-containing and silicon-containing precursor gas. In these examples, a thin interlayer of sputter-deposited silicon was used between the glass layer over the resistor strip and the Si-DLC coating. In Examples 4–6, the Si-DLC coating was ion beam deposited with a gridded Kaufmann-type ion beam source using TMS as the precursor gas, but the Si-DLC layer was deposited directly onto the glass layer over the resistor strip without an interlayer. In Examples 7, 8A and 8B, the Si-DLC coating was ion beam deposited with a gridless End Hall ion source using TMS as the precursor gas.

Comparative Examples 9–11, and Examples 12 and 13 elucidate the process for the deposition of the product illustrated in FIG. 3. Examples 12 and 13 illustrate an alternative application of the Si-DLC coating on thermal print heads which does not require the use of a glass layer.

The examples are for illustrative purposes and are not meant to limit the scope of the claims in any way.

Example 1

Commercially available thermal print heads with a glass-ceramic protective layer were used as substrates for coating with Si-DLC. The print head substrate was a piece of aluminum oxide, with dimensions of approximately 4.7 inches×0.8 inch×0.04 inch thick. The area of the substrate below the resistor strip was coated with a glass-ceramic projected glaze strip. A ruthenium oxide resistor strip with gold connection leads was applied over the projected glaze strip. The resistor strip was oriented parallel to the long side of the substrate, and was positioned approximately 0.22 inch from the edge of the substrate. An encapsulating layer of a borosilicate-type glass glaze layer, approximately 10–14 micrometers thick, was applied over top of the resistor strip.

Six thermal print heads were coated with a layer of ion beam deposited Si-DLC by the following procedure. The print heads were first cleaned with isopropyl alcohol by hand wiping with a cleanroom wipe, and dried in air. They were then mounted to a 6-inch diameter aluminum fixture plate using Kapton tape at the edge of the part. The electrical contacts on the print heads were masked with strips of Kapton tape. The fixture plate was then mounted to a water-cooled substrate platen in a vacuum chamber. The temperature of the cooling fluid in the platen was maintained in the range of 10° C. to 15° C. The vacuum chamber was then evacuated to a pressure of $4.7\times10^{-6}$ Torr by a diffusion pump assisted with a cryocoil.

Then, the glass surface of the print head substrates was sputter-etched for 2 minutes by a 137 mA, 500 Volt Ar ion beam generated in an 11 cm Kaufmann-type ion beam source (commercially available from Ion Tech, Inc., Fort Collins, Colo.). The distance between the ion source grids and the substrates was approximately 8 inches. Next, a 1000 Volt, 50 mA Ar ion beam was directed onto a Si sputtering target for 64 seconds, to ion beam sputter-deposit a 50 Å thick layer of Si onto the surface of the print heads. Next, a layer of Si-DLC of thickness ranging from 1.4 to 1.8 micrometers across the substrate holder was deposited on the print heads by directing at the print heads a 350 Volt, 100 mA ion beam generated from a precursor feed gas mixture of 3.6 sccm TMS and 5 sccm Ar. The substrate temperature during deposition of the Si-DLC coating was less than 100° C., and estimated to be less than 60° C. After completion of the 150 minutes deposition time, the process gases were extinguished, the vacuum chamber was vented to atmospheric pressure, and the Si-DLC coated thermal print heads were removed.

The Si-DLC coating had a thickness in the range of 1.4 to 1.8 micrometers, a Nanoindentation hardness of 16.5 GPa (as measured by a Nano Instruments Nanoindenter II versus a silicon (100) reference hardness of 11.5 GPa), and the following elemental composition as determined by Rutherford Backscattering Spectrometry and Hydrogen Forward Scattering Analysis: H (30.3 atomic %); C (49.7 atomic %); Si (17.7 atomic %); and Ar (2.3 atomic %). By Raman spectroscopy, the G-peak position in the Raman spectrum of the Si-DLC material was located at 1,489 $cm^{-1}$.

Example 2

The substrates and deposition conditions in Example 1 were repeated, except the deposition time of the Si-DLC layer was 300 minutes, to achieve a total coating thickness which varied across the substrate holder in the range of 2.8 to 3.6 micrometers. The Si-DLC coating had a Nanoindentation hardness of 16.0 GPa, and the following elemental composition as determined by Rutherford Backscattering Spectrometry and Hydrogen Forward Scattering Analysis: H (34.5 atomic %); C (47.9 atomic %); Si (15.5 atomic %); and Ar (2.1 atomic %). By Raman spectroscopy, the G-peak position in the Raman spectrum of the Si-DLC material was located at 1,489 $cm^{-1}$.

Example 3

The substrates and deposition conditions in Example 1 were repeated, except 10 substrates were coated, and the deposition time for the Si-DLC layer was 225 minutes, to achieve a total coating thickness which varied across the substrate holder, in the range of 2.0 to 2.7 micrometers. The Si-DLC coatings had a Nanoindentation hardness of 16.3 GPa, and the following elemental composition as determined by Rutherford Backscattering Spectrometry and Hydrogen Forward Scattering Analysis: H (32.5–34 atomic %); C (48–49.4 atomic %); Si (15.5–16 atomic %); and Ar (2.1–2.2 atomic %). By Raman spectroscopy, the G-peak position in the Raman spectrum of the Si-DLC material was located in the range of 1,488 $cm^{-1}$ to 1,492 $cm^{-1}$ Example 4

The substrates and deposition conditions in Example 3 were repeated, except that a Si layer was not deposited after the sputter-etch step, and the deposition time for the Si-DLC layer was 240 minutes, resulting in a Si-DLC coating thickness which varied across the substrate holder in the range of 2.2 to 2.9 micrometers. In this run, even though the Si-DLC layer was deposited directly onto the glass surface of the print head substrate without the aid of a Si interlayer, the Si-DLC coating adhesion was excellent.

Example 5

Substrates identical to those described in Example 1 were coated with ion beam deposited Si-DLC in a larger coating chamber, capable of uniformly depositing the Si-DLC material on a 12-inch diameter substrate holder which was located inside a high vacuum chamber with interior dimensions of approximately 54 inches×54 inches×60 inches.

A rotatable substrate platen was mounted vertically on a stand inside the vacuum chamber. A 16 cm Kaufmann-type gridded ion source (commercially available from Commonwealth Scientific Corporation, Alexandria, Va.) was positioned in the vacuum chamber so that the distance between the ion source grids and the substrate platen was 15 inches, and the ion beam axis (centerline of the ion beam) was pointed at a position approximately 5.25 inches from the center of rotation of the platen, at an angle of incidence of 30 degrees. There was no independent substrate heating capability in the system. During the process, the plate was rotated at approximately 4.5 rpm.

Four print heads were chemically cleaned and mounted on a 12-inch diameter flat plate using Kapton tape. The samples were stacked in a pyramid fashion to mask contact points, exposing an area approximately 0.375 inch×4.7 inches, which included the glass-encapsulated resistor strip. One reject thermal print head substrate was placed on the top of the pyramid to shield the Kapton tape from the ion beam. An additional scrap substrate was taped onto the plate to be used for testing. Additional witness samples included were a silicon wafer strip, a stainless steel coupon, and a glass microscope slide.

After loading the samples, the vacuum chamber was pumped down to a base pressure of approximately $4\times10^{-6}$ Torr, by a Varian VHS-10 diffusion pump assisted by a cryocoil. The 16 cm Kaufmann-type gridded ion source was then warmed up by idling behind a shutter with an Ar discharge only for 20 minutes. When the warm-up was complete the shutter was opened, and the substrates were subjected to Ar ion sputter-etching for 5 minutes at a beam current of 250 mA and a beam voltage of 350 Volts, resulting in a surface etch of approximately 400 Å.

Following completion of the sputter-etch step, the shutter was closed, and the Ar gas flow to the ion source was increased to 32 sccm, and 21.6 sccm TMS was introduced into the plasma chamber of the ion source. When the ion source parameters had stabilized at a beam voltage of 350 Volts and a beam current of 250 mA, the shutter was opened, and the deposition of Si-DLC was initiated. The deposition was continued for 120 minutes, at a process pressure of $2.7\times10^{-4}$ Torr, resulting in an Si-DLC coating which was 1.7 micrometers thick. The maximum substrate temperature during the deposition of the Si-DLC coating was in the range of 100° C. to 200° C., as indicated by temperature indicating tab placed on the back side of the substrates. The elevated substrate temperature was the result of heating by the ion bombardment process during deposition, and radiation from the ion beam source and filament neutralizer.

The glass microscope slide, stainless steel coupon, and reject thermal print head substrate were subjected to a boiling water-to-ice water thermal shock adhesion test which involved 14 cycles of alternating immersion of the samples in boiling water for 5 minutes, followed by ice water for 5 minutes. No delamination or peeling of the coating was seen on any of the samples, indicating excellent adhesion of the Si-DLC coating. A Nanoindentation hardness of 19.5 GPa was measured for the Si-DLC coating deposited on the silicon chip substrate. The following elemental composition as determined by Rutherford Backscattering Spectrometry and Hydrogen Forward Scattering Analysis: H (32 atomic %); C (49 atomic %); Si (17 atomic %); and Ar (1.2 atomic %). The remaining Si-DLC coated thermal print heads were packaged into complete printer head assemblies and wear-tested.

Example 6

Substrates identical to those described in Example 1 were coated with ion beam deposited Si-DLC in the same coating chamber used in Example 5, but the configuration was modified resulting in uniform deposition the Si-DLC material across a 24-inch diameter substrate platen.

Five print heads were mounted on a 24-inch diameter flat plate using kapton tape. The tape masked the contact points, exposing an area approximately 0.375×4.700 in. which included the glass-encapsulated resistor strip. The print heads were placed in areas on the plate that would represent the profile of the entire diameter. One reject print head and one silicon sample were placed in a corresponding location along with each good print head.

The sample plate was mounted vertically on a stand and positioned such that the center of the plate was 24 inches from the face of the ion source and approximately 11.75 inches from the center of the beam at an angle of 30 degrees. During the process the plate was rotated at approximately 12 rpm.

After loading the samples the vacuum chamber was pumped down to a base pressure of approximately $6.9\times10^{-6}$ Torr. The 16 cm Kaufmann-type gridded ion source was then warmed up behind a shutter, as in Example 5. When the warmup was complete the shutter was opened, and the substrates were subjected to Ar ion sputter-etching for 5 minutes at a beam current of 400 mA and a beam voltage of 350 Volts, resulting in a surface etch of approximately 400 Å.

Following completion of the sputter-etch step, the shutter was closed, and the Ar gas flow to the ion source was increased to 32 sccm, and 21.6 sccm TMS was introduced into the plasma chamber of the ion source. When the ion source parameters had stabilized at a beam voltage of 750 Volts and a beam current of 350 mA, the shutter was opened, and the deposition of Si-DLC was initiated. The deposition was continued for 55 minutes, at a process pressure of $1.5\times10^{-4}$ Torr, resulting in an Si-DLC layer which was 0.28 micrometer thick. Then, the process gas flows were then increased to 72 sccm for Ar and 72 sccm of TMS, to increase the deposition rate. The vacuum chamber pressure increased to $2.4\times10^{-4}$ Torr. After depositing for an additional 245 minutes at this condition, the ion beam was extinguished, the chamber was vented with air, and the Si-DLC coated substrates were removed from the chamber. The maximum substrate temperature during the deposition of the Si-DLC coating was in the range of 100° C. to 200° C., as indicated by temperature indicating tab placed on the back side of the substrates. The elevated substrate temperature was the result of heating by the ion bombardment process during deposition, and radiation from the ion beam source and filament neutralizer.

The thickness of the Si-DLC coating on the silicon strips ranged from 2.7 microns in the center of the substrate platen to 3.2 microns at the outer edge of the platen.

The reject thermal print head substrates were subjected to the same thermal shock test described in Example 5, and no delamination of the coating was found. Then, the same coated print heads were immersed in an activated ultrasonic bath filled with deionized water for 15 minutes as an additional test of adhesion. No delamination of the coating was found, indicating excellent adhesion. Nanoindentation hardness values of 15.5 to 18.4 GPa were obtained on the Si-DLC coated silicon chip samples, depending on their position on the substrate platen. The samples in the center of the platen had the lowest hardness of 15.5 GPa. The following range of elemental compositions of the Si-DLC coatings was determined by Rutherford Backscattering Spectrometry and Hydrogen Forward Scattering Analysis: H (28–32 atomic %); C (53–54.5 atomic %); Si (15–16.8 atomic %); and Ar (0.3–1.2 atomic %). The remaining Si-DLC coated thermal print heads were packaged into complete printer head assemblies and wear-tested.

For the deposition of Si-DLC coatings deposited using the Kaufman-type ion beam source process configuration described in Example 6, the following process conditions were found to produce optimum results of an Si-DLC coating with hardness greater than or equal to 17 GPa and outstanding wear resistance: TMS flow in the range of 20 to 72 sccm; beam voltage in the range of 350 to 900 Volts, most preferably in the range of 600 to 900 Volts; beam current in the range of 0.25 to 0.35 Amp.

Example 7

Thermal print head substrates identical to those described in Example 1 were coated with ion beam deposited Si-DLC in the same coating chamber of the same size as the chamber in Example 5, but using a gridless End Hall ion source for deposition.

Two print heads were chemically cleaned and mounted on a flat plate using Kapton tape to secure them and to mask the contact points. Silicon and quartz witness samples were also mounted to the substrate holder with Kapton tape. Infrared heat lamps were mounted directly behind the substrate holder. The substrate holder was not rotated or moved during the process. The substrate holder was positioned 10 inches downstream of the front plate of a Mark II End Hall ion source (Commonwealth Scientific, Alexandria, Va.).

The chamber was pumped down to a base pressure, and the substrates were heated to approximately 150° C. by radiation from the infrared lamps. Then, the substrates were sputter-etched with an Ar ion beam generated by operating the End Hall source on 20 sccm of Ar gas feed to the discharge cavity of the source, and at an anode voltage of 100 Volts and an anode current of 15 Amps for 5 minutes. Upon completion of the sputter-etching step, the Ar gas flow was reduced to 8 sccm, and 30 sccm of TMS was introduced into the ion beam through a nozzle located approximately 1 inch downstream of the ion source, to initiate deposition of a Si-DLC coating on the substrates. The anode current was reduced to 10 Amps, and the anode voltage was increased to 120 Volts. The Si-DLC deposition process was continued for 40 minutes, at which time the plasma in the End Hall source was extinguished and the process gas was turned off. Then, the vacuum chamber was vented with air, and the Si-DLC coated thermal print head substrates were removed.

The Si-DLC coating thickness was approximately 2.2 micrometers, and the Nanoindentation hardness of the coating was 17 GPa. Using a CSEM pin-on-disk friction test apparatus with a sapphire ball sliding against an Si-DLC coated quartz coupon from this run, under a load of 206 grams, with a track diameter of approximately 0.75 inch, a friction coefficient of 0.07 was measured.

The following range of elemental compositions of the Si-DLC coatings was determined by Rutherford Backscattering Spectrometry and Hydrogen Forward Scattering Analysis: H (26 atomic %); C (48 atomic %); Si (22 atomic %); Ar (2.4 atomic %); and Mo (0.8 atomic %).

One of the Si-DLC thermal print head substrates were subjected to the same thermal shock test described in Example 5, and no delamination of the coating was found. Then, the same coated print heads were immersed in an activated ultrasonic bath filled with deionized water for 15 minutes as an additional test of adhesion. No delamination of the coating was found, indicating excellent adhesion. One of the Si-DLC coated thermal print heads was packaged into a complete printer head assembly and wear-tested.

Examples 8A and 8B

Thermal print head substrates identical to those described in Example 1 were coated with ion beam deposited Si-DLC in the same coating chamber of the same size as the chamber in Example 7, using gridless End Hall ion sources for deposition, and a large rotating substrate holder.

Two Mark II End-Hall gridless ion sources mounted on a stand were positioned inside a rotating drum cylindrical fixture having a circumference of 147 inches and a height of approximately 14 inches. The End Hall sources were positioned with the front face of the source approximately six inches from the inside surface of the sample fixtures which were mounted on the inside of the cylinder. Shields spaced 6 inches apart were placed in front of the ion sources to limit the exposure of the substrates to only the center portion of the ion beam directly in front of the ion sources. Infrared lamps were located behind the sample fixtures to provide auxiliary substrate heating.

Thirteen print heads were chemically cleaned and then mounted in a fixture that consisted of an aluminum card machined out for the substrates to lay flush and a cover that masked the contact areas of the print heads. An area approximately 0.375 inch×4.7 inches, which included the resistor strip, was exposed for coating. A second card fixture was used to mount silicon wafer strips, glass slides, and quartz squares. One of each type of sample was placed on the top section of the card and one on the bottom to measure the coating properties for each ion source. These witness samples were attached to the fixture using kapton tape. Carbon dots were placed on the silicon strips for measuring the coating thickness. No other masking of the witness samples was utilized. The fixtures were hung vertically on the inside of the barrel, along with 28–35 other cards loaded with glass to fill the drum. The drum was rotated at 20 rpm during the process.

After the vacuum chamber was evacuated to a pressure of $1.4\times10^{-4}$ Torr by two Varian VHS-10 diffusion pumps and two cryocoils, the substrates were sputter-etched with an Ar ion beam for 75 minutes by operating each End Hall source on Ar gas at an anode current of 15 Amps and anode voltage of approximately 100 Volts. At the start of sputter-etching step, the heating lamps were turned on to raise the substrate temperature to 325° C., in preparation for the deposition of Si-DLC. Upon completion of the sputter-etching step, the anode current was increased to 18 Amps on both ion sources, and 60 sccm of TMS was introduced for each source through nozzles positioned approximately 1 inch downstream of the face of each source. The introduction of the TMS precursor gas increased the chamber pressure to approximately $1.7\times10^{-3}$ Torr. The deposition of Si-DLC was carried out at these conditions for 180 minutes, at which time the plasmas and process gases were extinguished, and the substrates were left to cool down to near room temperature. Then, the vacuum chamber was vented with air, and the Si-DLC coated thermal print head substrates, and other samples were removed.

The following properties of the Si-DLC coatings were measured. The coating thickness was in the range of 2.49 to 2.55 micrometers, the Nanoindentation hardness was in the range of 17.5 to 19 GPa, and the dynamic friction coefficient for the coating against a sapphire ball was 0.09. The following range of elemental compositions of the Si-DLC coatings was determined by Rutherford Backscattering Spectrometry and Hydrogen Forward Scattering Analysis: H (35 atomic %); C (40.5–42 atomic %); Si (22–24 atomic %); Ar (0.45–0.7 atomic %); and Mo (0.1–0.14 atomic %).

Three Si-DLC coated thermal print heads were subjected to the same thermal shock test described in Example 5, and no delamination of the coating was found. Then, the same coated print heads were immersed in an activated ultrasonic bath filled with deionized water for 15 minutes as an additional test of adhesion. No delamination of the coating was found, indicating excellent adhesion. Several of the Si-DLC coated thermal print heads were packaged into complete printer head assemblies and wear-tested.

For the deposition of Si-DLC coatings deposited using the gridless End Hall ion source process configuration described in Examples 8A and 8B, the following process conditions were found to produce optimum results of an Si-DLC coating with hardness greater than or equal to 17 GPa and outstanding wear resistance: TMS flow in the range of 30 to 75 sccm; anode voltage in the range of 95 to 140 Volts; anode current in the range of 16 to 20 Amps; substrate temperature in the range of 150° C. to 500° C. The most preferable substrate temperature is in the range of 300° C. to 500° C.

Thermal print heads which were coated with layers of Si-DLC in the previous Examples 1–8 were tested for abrasive lifetime by printing labels using a commercial thermal printer. The condition of the thermal print heads was examined after printing approximately 2,000 labels, and at increments of approximately 2,000 labels thereafter, until a level of 20,000 labels was reached. At that point, until completion of the test, the print heads were examined after printing increments of 5,000 labels. The test was stopped at the point where the print heads were considered failed as indicated by a resistance change of greater than 15% in any of the resistor elements. The results for the Si-DLC coated thermal print heads are presented in Table 1.

By comparison, thermal print heads composed of an aluminum oxide substrate, a glass-ceramic projected glaze strip, a RuO resistor strip, and a glass-ceramic protective glaze layer (see Control A, "Glass," in Table 1) failed after printing between 5,000 and 20,000 labels. Further, a thermal print head composed of an aluminum oxide substrate, a 50 to 60 micrometers thick projected glaze strip, a 2-micron thick tantalum oxide resistor strip, and a protective coating of silicon nitride (see Control B, "SiN," in Table 1) with a thickness of 6 to 7 micrometers and Nanoindentation hardness of 23 GPa failed at 48,000 labels.

TABLE 1

| Example | Test Sample Identification | Description of Layers Over Aluminum Oxide Substrate | No. of Labels to Failure |
|---|---|---|---|
| Control A | Glass | Glass/RuO/10 μm Glass | 5,000–20,000 |
| Control B | SiN | 50–60 μm Glass /6–7 μm SiN | 48,000 |
| 1 | Si–DLC | Glass/RuO/10 μm Glass/1.4–1.8 μm Si–DLC | 22,000 |
| 2 | Si–DLC | Glass/RuO/10 μm Glass/2.8–3.6 μm Si–DLC | >36,000* |
| 3 | Si–DLC | Glass/RuO/10 μm Glass/2–2.7 μm Si–DLC | 80,000 |
| 5 | Si–DLC | Glass/RuO/10 μm Glass/1.7 μm Si–DLC | 51,000 |
| 6 | Si–DLC | Glass/RuO/10 μm Glass/2.7–3.2 μm Si–DLC | >60,000* |
| 7 | Si–DLC | Glass/RuO/10 μm Glass/2.2 μm Si–DLC | 60,000 |
| 8A | Si–DLC | Glass/RuO/10 μm Glass/2.5 μm Si–DLC | >50,000* |
| 8B | Si–DLC | Glass/RuO/10 μm Glass/2.5 μm Si–DLC | >20,000* |

*Note: Test was stopped prematurely after this number of printed labels.

Example 9

An alumina substrate having dimensions 4.5 inches×4.5 inches×0.03 inch thick was pattern metallized with a layer of NiCr (nichrome) to define the heating elements for 8 thermal print heads. The apparatus described in Example 5 was used in an effort to deposit Si-DLC coatings of a thickness 1.5 and 3 micrometers onto the NiCr material.

The substrates were cleaned and mounted onto the substrate platen, then the vacuum chamber was evacuated to $8.5\times10^{-6}$ Torr. Following completion of the ion source warm-up cycle as in Example 5, the Ar gas flow to the source was increased to 32 sccm, and 21.6 sccm of TMS was introduced into the ion source. When the ion beam source was stabilized at a beam voltage of 350 Volts and a beam current of 250 mA, the shutter was opened to initiate deposition of Si-DLC onto the NiCr-coated substrates. (Note that the substrates were not sputter-etched prior to initiation of the Si-DLC deposition.) At 20 minutes into the deposition cycle, the process gas flows were increased to 72 sccm Ar and 72 sccm TMS. All other process parameters remained the same; the chamber pressure was $5.6\times10^{-4}$ Torr. After 46 minutes of deposition at these conditions, the plasma in the ion source was extinguished, the process gases were turned off, and the vacuum chamber was vented to air.

The resulting coating was 1.7 micrometers thick. Upon close examination it was evident that the Si-DLC coating exhibited poor adhesion to the substrate materials.

Example 10

A set of substrates identical to those used in Example 9 were cleaned and loaded into the same vacuum chamber, which was evacuated to a pressure of $8.2\times10^{-6}$ Torr. After the ion source was warmed, as described in Example 5, the substrates were exposed to a 5-minute sputter-etch step consisting of a 400 Å etch using 20 sccm Argon with the process parameters as in Example 5.

After the sputter-etch step was completed, the shutter was closed and the process gas flows were adjusted to 32 sccm Ar and 21.6 sccm TMS, both introduced through the plasma of the ion source. When the ion beam source was stabilized at a beam voltage of 350 Volts and a beam current of 250 mA, the shutter was opened to initiate deposition of Si-DLC onto the NiCr-coated substrates. Deposition of Si-DLC continued for 20 minutes, at which point the process gas flows were increased to 72 sccm Ar and 72 sccm TMS. After depositing at this condition for an additional 100 minutes, the ion source plasma was extinguished, the process gases were turned off, and the vacuum chamber was vented to atmospheric pressure and the coated substrates were removed.

The thickness of the Si-DLC coating was approximately 3.2 micrometers. It was found that while the Si-DLC coating adhered well to the NiCr material, the inherent compressive stress of the Si-DLC layer caused adhesion failure at the interface between the NiCr material and the alumina substrate. Although it is believed that this failure was due to poor adhesion of the metallization to the alumina surface, it was necessary to develop an alternative approach to obtain an adherent, wear-resistant Si-DLC coated print head.

Example 11

The process of Example 10 was repeated on another set of thermal print head substrates identical to those used in Example 9, but the Si-DLC coating thickness was decreased to 1.5 micrometers to reduce the stress at the interface between the NiCr layer and the alumina substrate. Prior to testing, the adhesion of the Si-DLC coating appeared to be good, as evidenced by the coating remaining intact after immersion in an ultrasonic bath for 40 minutes. Two of the Si-DLC coated thermal print heads were placed in a QUV weathering environmental test chamber, where they were exposed to alternating cycles of UV-B radiation for 4 hours at 50° C., and 4 hours of condensation at 50° C. After 17 hours exposure, the coatings were observed to have undergone adhesion failure at the interface between the NiCr layer and the alumina substrate.

Example 12

The processes in Example 10 and 11 are repeated, except that a layer of silicon oxy-carbide, in the thickness range of approximately 1 to 10 micrometers is deposited by ion beam deposition using an End Hall ion beam source prior to the deposition of the Si-DLC layer. The silicon oxy-carbide layer is deposited by operating the ion beam source on oxygen gas, and introducing octamethylcyclotetrasiloxane precursor gas into the ion beam through a nozzle located approximately 1 inch downstream of the ion source anode. The resulting structure of an alumina substrate, a resistive layer of NiCr, an insulating layer of silicon oxy-carbide, and a wear-resistant layer of SI-DLC exhibits excellent adhesion. The internal stress of the silicon oxy-carbide layer is less than 0.2 GPa, which is much lower than the stress of the SI-DLC layer, which is in the range of 1.2 to 1.5 GPa. The silicon oxy-carbide layer improves adhesion because it acts as a buffer between the SI-DLC layer and the NiCr-alumina substrate interface, reducing the transfer of stresses from the SI-DLC layer to that interface.

Example 13

Alumina substrates having dimensions 4.5 inches×4.5 inches×0.03 inch thick were pattern metallized with a layer of NiCr (nichrome) to define the heating elements for 8 thermal print heads. The NiCr layer was overcoated with a layer of low compressive stress aluminum oxide, having a thickness of approximately 2 micrometers and a Nanoindentation hardness in the range of 9.5–10 GPa. The aluminum oxide layer was capped with a 400 Å thick layer of silicon dioxide.

The substrates were blown off with dry air to remove particulates, and mounted into the vacuum chamber as in Example 10. The chamber was evacuated to a pressure of less than $8\times10^{-6}$ Torr. After completion of the warm-up phase for the ion source, a 5-minute Ar sputter-etch step was completed on the substrates, which etched away most or all of the silicon dioxide layer. Then, deposition of SI-DLC was initiated using a beam current of 250 mA, and a beam voltage of 350 Volts, with 32 sccm Ar and 21.6 sccm TMS precursor gas flow. The ion beam source was operated at these conditions for 10 minutes to deposit a thickness of approximately 0.15 micrometer of SI-DLC. Then, the gas flow rates to the ion source were increased to 72 sccm Ar and 72 sccm TMS. Deposition at these conditions was continued for another 13 minutes to achieve an additional thickness of 0.5 micrometer of SI-DLC, at which time the deposition process was terminated. The vacuum chamber was vented to air, and the substrates were removed, coated with a layer of SI-DLC approximately 0.55 micrometer thick.

The Nanoindentation hardness of the SI-DLC coating was approximately 18 GPa. The print heads were wear tested and found to be much more robust than print heads coated only with the 2 micrometer thick layer of aluminum oxide.

The layer of low stress aluminum oxide applied over the NiCr improved the adhesion of the Si-DLC layer, by acting as a buffer between the Si-DLC layer and the NiCr-alumina substrate interface.

Based on microscopic examination of the print heads which were tested, the requirements for a successful Si-DLC coating for thermal print heads are evident.

Three types of scratches were found: "galling-type scratches" caused by rubbing under high friction conditions, "indentation-type scratches" caused by rubbing with hard particles under light load, and "deep gouging scratches" caused by rubbing with hard particles under high load.

The first type of scratch which is apparent on glass surfaces is the "galling" type scratch which is a wide, shallow scuffing-type scratch. This type of scratch occurs when two surfaces of similar chemistry (e.g. oxides such as silica) are rubbed together without lubrication. A low friction Si-DLC coating can stop this mode of scratching due to the low friction nature of these coatings. Effectively, the Si-DLC coating acts as a solid lubricant.

Indentation-type scratches occur when a particle which is much harder than the substrate rubs across the substrate under a light to moderate load. These scratches are visible, but typically do not penetrate through the entire protective coating, e.g. the glass layer in the prior art print heads. Repeated occurrences of indentation-type scratches and galling-type scratches in the protective coating result in a gradual layer-by-layer wear through the protective coating. Thin (approximately 0.1 micrometer thick) Si-DLC coatings will not stop these indentation scratches. However, Si-DLC coatings which are approximately 0.5 micrometers thick or greater are able to stop these scratches. High hardness of the Si-DLC coating (i.e. hardness of approximately 10 GPa or greater) is also important for stopping these indentation-type scratches.

Deep gouging scratches occur when a particle which is much harder than the substrate rubs across the substrate under a high load. These types of scratches occur frequently on thermal print heads which are subjected to highly abrasive conditions, such as in printing tickets and some bar code labels, but typically not in facsimile machines or other applications which are suited to thin film thermal heads. These scratches can produce catastrophic failure in the thermal print head by gouging through the protective coating and damaging the resistor elements, which then disables portions of the print head. Thin Si-DLC coatings are penetrated by these types of scratches. The ability of the Si-DLC coatings to stop this type of scratch is determined by the total coating thickness, hardness, and coefficient of friction. To achieve optimum wear resistance, the Si-DLC coatings of the present invention have a thickness in the range of approximately 0.5 to 20 micrometers, hardness in the range of approximately 10 GPa to 35 GPa, and dynamic friction coefficient of less than approximately 0.2. For thermal print heads which are subjected to highly abrasive wear conditions, it is preferable to have a Si-DLC coating with hardness in the range of approximately 15 GPa to 35 GPa, a thickness in the range of approximately 2 to 10 micrometers, and a dynamic friction coefficient of less than approximately 0.15.

It is also critical for the Si-DLC coating to have high thermal stability. Since the operating temperature of the resistor element can reach 400° C. or greater, it is critical that the protective coating does not bum, or change thickness when exposed to this temperature in an air environment. This requirement for high temperature stability eliminates most prior art DLC coating materials from consideration for application to thermal print heads. To achieve the required thermal stability, silicon dopant atoms are added to the diamond-like carbon coating to form Si-DLC. The concentration range of Si atoms in the Si-DLC coating is in the range of approximately 5 atomic % to 40 atomic %. Below 5 atomic %, the improvement in thermal stability is not sufficient, and above 40 atomic % the coating hardness is reduced and the friction coefficient increases. Preferably, for optimal performance of the Si-DLC coating, the Si concentration is in the range of approximately 10 atomic % to 30 atomic %. When the Si concentration in the Si-DLC coating is in the range of approximately 10 atomic % to 20 atomic %, the coating is stable in air at temperature in the range of approximately 450° C. to 500° C.

In addition to the properties of outstanding wear resistance, low friction and high thermal stability, the Si-DLC coatings having Si concentrations in the aforementioned ranges exhibit excellent adhesion to materials such as aluminum oxide, glass, silicon nitride, tantalum oxide and nichrome which are commonly used in thermal print heads. This is another advantage of the Si-DLC coatings of the present invention over prior art DLC coatings, which require interlayers for good adhesion to materials such as aluminum oxide, glass and nichrome.

Finally, the Si-DLC coatings of the present invention exhibit high atomic packing density, and are highly resistant to chemical attack by chemicals present in paper and in the environment, including water, salts, acids and organic compounds.

The Examples and the previous discussion clearly illustrate the advantages of the Si-DLC coated thermal print head products of the present invention over prior art techniques. The Si-DLC coatings of the present invention exhibit outstanding adhesion thermal stability and wear-resistance, hence longer useful life compared to prior art thermal print heads. The process for manufacture of Si-DLC coatings of the present invention is readily scaled-up to mass production volumes.

Without departing from the spirit and scope of this invention, one of ordinary skill in the art can make various changes and modifications to the invention to adapt it to various usages and conditions. As such, these changes and modifications are properly, equitably, and intended to be, within the full range of equivalents of the following claims.

What is claimed is:

1. A thermal print head coated with a highly wear resistant protective coating of silicon-doped diamond-like carbon, said coating having the properties of Nanoindentation hardness in the range of about 10 GPa to about 35 GPa, thickness in the range of about 0.5 micrometer to about 20 micrometers, a silicon concentration in the range of about 10 atomic % to about 30 atomic %, and a thermally stability in air at temperatures in the range of 400° C. to 500° C.

2. The thermal print head of claim 1 wherein said coating also includes the elements selected from the group of oxygen and nitrogen.

3. The thermal print head of claim 1 wherein the hardness of said coating is in the range of about 15 GPa to about 35 GPa.

4. The thermal print head of claim 1 wherein the thickness of said coating is in the range of about 2 micrometers to about 10 micrometers.

5. The thermal print head of claim 1 wherein the dynamic friction coefficient of said coating is less than about 0.15.

6. The thermal print head of claim 1 wherein the hardness of said coating is in the range of about 15 GPa to about 19 GPa, the hydrogen concentration in said coating is in the range of about 26 atomic percent to about 35 atomic percent, the carbon concentration in said coating is in the range of about 40 atomic percent to about 54 atomic percent, and the silicon concentration in said coating is in the range of about 15 atomic percent to about 24 atomic percent.

7. A thermal print head comprising an aluminum oxide substrate coated with a first layer of glass, a second layer comprising a plurality of heating elements of electrically resistive material having electrical connections for heating, a third layer of glass, and a fourth layer of a protective coating of silicon-doped diamond-like carbon, said coating having the properties of Nanoindentation hardness in the range of about 10 GPa to about 35 GPa, thickness in the range of about 0.5 micrometer to about 20 micrometers, and a silicon concentration in the range of about 10 atomic % to about 30 atomic %.

8. The thermal print head of claim 7 wherein the hardness of said coating is in the range of about 15 GPa to about 35 GPa, the thickness of said coating is in the range of about 2 micrometers to about 4 micrometers, and the silicon concentration of said coating is in the range of about 15 atomic % to about 25 atomic %.

9. The thermal print head of claim 7 wherein the hardness of said coating is in the range of about 15 GPa to about 19 GPa, the hydrogen concentration in said coating is in the range of about 26 atomic percent to about 35 atomic percent, the carbon concentration in said coating is in the range of about 40 atomic percent to about 54 atomic percent, and the silicon concentration in said coating is in the range of about 15 atomic percent to about 24 atomic percent.

10. A thermal print head comprising an aluminum oxide substrate coated with a first layer comprising a plurality of heating elements of electrically resistive material having electrical connections for heating, a second layer of ceramic material, and a third layer of a protective coating of silicon-doped diamond-like carbon, said coating having the properties of Nanoindentation hardness in the range of about 10 GPa to about 35 GPa, thickness in the range of about 0.5 micrometer to about 20 micrometers, and a silicon concentration in the range of about 10 atomic % to about 30 atomic %.

11. The thermal print head of claim 10 wherein said ceramic material is chosen from the group consisting of aluminum oxide, titanium oxide, tantalum oxide, silicon carbide silicon oxide, silicon nitride, silicon oxy-nitride, silicon oxy-carbide, or mixtures thereof, and the hardness of said coating is in the range of about 15 GPa to about 35 GPa, the thickness of said coating is in the range of about 0.5 micrometers to about 4 micrometers, and the silicon concentration of said coating is in the range of about 15 atomic % to about 25 atomic %.

12. The thermal print head of claim 10 wherein the hardness of said coating is in the range of about 15 GPa to about 19 GPa, the hydrogen concentration in said coating is in the range of about 26 atomic percent to about 35 atomic percent, the carbon concentration in said coating is in the range of about 40 atomic percent to about 54 atomic percent, and the silicon concentration in said coating is in the range of about 15 atomic percent to about 24 atomic percent.

13. A method for producing a protective, wear resistant silicon-doped diamond-like carbon coating on the wear surface of a thermal print head comprising the steps of:

(a) depositing a patterned layer of resistive material onto an electrically insulating substrate;

(b) depositing a protective layer selected from the group consisting of glass, glass-ceramic, a ceramic material and mixtures thereof onto the surface of said patterned layer of resistive material;

(c) ion-assisted plasma depositing a silicon-doped diamond-like carbon coating onto said substrate to a predetermined thickness in vacuum by introducing carbon-containing and silicon-containing precursor gases into a vacuum chamber containing said substrate;

(d) increasing the vacuum chamber pressure to atmospheric pressure; and (e) recovering a silicon-doped diamond-like carbon coated thermal print head having improved resistance to wear, abrasion and corrosion.

14. The method of claim 13 wherein said precursor gases are selected from the group consisting of hydrocarbon, silane, organosilane, organosilazane and organo-oxysilicon compounds, and mixtures thereof.

15. The method of claim 14 wherein said hydrocarbon compound is selected from the group consisting of methane, ethane, butane, acetylene, cyclohexane and mixtures thereof.

16. The method of claim 14 wherein said silane compound is selected from the group consisting of silane, disilane and mixtures thereof.

17. The method of claim 14 wherein said organosilane compound is selected from the group consisting of diethylsilane, tetramethylsilane and mixtures thereof.

18. The method of claim 14 wherein said organosilazane compound is selected from the group consisting of hexamethyldisilazane, tetramethyldisilazane and mixtures thereof.

19. The method of claim 14 wherein said organo-oxysilicon compound is selected from the group consisting of hexamethyldisiloxane, tetramethyldisiloxane, ethoxytrimethylsilane, octamethycyclotetrasiloxane, and mixtures thereof.

20. The method of claim 13 wherein said ion-assisted plasma is an ion beam generated from a plasma of carbon-containing and silicon-containing precursor gases.

21. The method of claim 13 wherein said ion-assisted plasma is a capacitive radio frequency plasma generated from carbon-containing and silicon-containing precursor gases.

22. The method of claim 13 wherein the thickness of the silicon-doped diamond-like carbon coating is in the range of about 0.5 micrometers to about 20 micrometers.

23. The method of claim 13 wherein a protective layer selected from the group consisting of glass, glass-ceramic, a ceramic material and mixtures thereof is deposited onto the surface of said electrically insulating substrate prior to step (a).

24. The method of claim 23 wherein said silicon-doped diamond-like carbon coating is deposited using a gridless ion source.

25. The method of claim 13 wherein a protective layer selected from the group consisting of glass, glass-ceramic, a ceramic material and mixtures thereof is deposited onto the surface of said electrically insulating substrate after step (a) and prior to step (b).

26. The method of claim 25 wherein said silicon-doped diamond-like carbon coating is deposited using a gridless ion source.

27. The method of claim 23 a protective layer selected from the group consisting of glass, glass-ceramic, a ceramic material and mixtures thereof is deposited onto the surface of said electrically insulating substrate after step (a) and prior to step (b).

28. The method of claim 27 wherein said silicon-doped diamond-like carbon coating is deposited using a gridless ion source.

29. The method of claim 13 wherein said silicon-doped diamond-like carbon coating is deposited using a gridless ion source.

30. The method of claim 29 wherein a temperature in the range of 150° C. to 500° C. is maintained during the deposition using said gridless ion source.

31. The method of claim 30 wherein a temperature in the range of 300° C. to 500° C. is maintained during the deposition using said gridless ion source.

* * * * *